US005901546A

United States Patent [19]

Lovas et al.

[11] Patent Number: 5,901,546

[45] Date of Patent: May 11, 1999

[54] FIBER CONVEYING CHANNEL FOR A SPINNING MACHINE

[75] Inventors: Kurt Lovas, Böhmfeld; Eberhard Hofmann, Ingolstadt, both of Germany

[73] Assignee: Rieter Ingolstadt Spinnereimaschinenbau AG, Ingolstadt, Germany

[21] Appl. No.: 08/909,536

[22] Filed: Aug. 12, 1997

[30] Foreign Application Priority Data

Aug. 16, 1996 [DE] Germany ..... 196 32 888

[51] Int. Cl.[6] ..... D01H 4/00

[52] U.S. Cl. ..... 57/413; 57/408

[58] Field of Search ..... 57/408, 409, 411, 57/413, 415, 417, 352; 72/61, 62

[56] References Cited

U.S. PATENT DOCUMENTS

| | | | |
|---|---|---|---|
| 3,956,876 | 5/1976 | Artzt et al. | 57/413 |
| 4,014,162 | 3/1977 | Stahlecker | 57/413 |
| 4,245,460 | 1/1981 | Staufert et al. | 57/413 |
| 4,291,528 | 9/1981 | Miyamoto et al. | 57/413 |
| 4,459,800 | 7/1984 | Stahlecker . | |
| 4,829,803 | 5/1989 | Cudini | 72/61 |
| 5,203,190 | 4/1993 | Kramer et al. | 72/62 |
| 5,214,948 | 6/1993 | Sanders et al. | 72/62 |
| 5,491,966 | 2/1996 | Billner | 57/413 |
| 5,685,137 | 11/1997 | Raasch | 57/408 |

FOREIGN PATENT DOCUMENTS

| | | |
|---|---|---|
| 2800795 | 7/1979 | Germany . |
| 3734544A1 | 5/1989 | Germany . |
| 4320656A1 | 1/1995 | Germany . |
| 4322711A1 | 1/1995 | Germany . |
| 19511084A1 | 9/1996 | Germany . |
| 1471967 | 4/1977 | United Kingdom . |

*Primary Examiner*—William Stryjewski
*Attorney, Agent, or Firm*—Dority & Manning

[57] ABSTRACT

With channels for the conveying of fibers, fiber slivers or yarns on spinning machines, problems are encountered in their manufacture. The channels must be made with a certain inside contour, where at the same time the quality of the surface inside the channel must be very good. The high surface quality is required in order to ensure trouble-free conveying. A channel is therefore proposed which is made as a tubular component, consisting of a metallic material and which has been produced by forming its interior by a medium under pressure. It is proposed for an open-end rotor spinning device to form the conveying channel separately from the other components of the lid of the rotor housing and to insert the channel into the lid. It is proposed in that case to use a channel according to the design shown above.

12 Claims, 8 Drawing Sheets

FIBER CONVEYING CHANNEL FOR A SPINNING MACHINE

BACKGROUND OF THE INVENTION

The present invention relates to a channel for the guidance or conveying of fibers, fiber slivers or yarns in a spinning machine, an open-end spinning device with such a channel, as well as a process for the manufacture of such a channel. A spinning machine with an open-end rotor spinning device is known from DE-A 37 34 544, in which the rotor housing is closed by means of a rotor lid, whereby the rotor lid and the channel located therein for the conveying of fibers into the spinning rotor are made in one piece by means of a molding or injection molding process. In order to obtain a bent form of the channel, the channel for fiber conveying is designed in such a manner in the open-end spinning device described in DE-A 37 34 544 that its two openings, the input opening for fibers and the output opening, are larger than the area of the channel between them, which is generally called the fiber feeding channel in open-end spinning machines. As a result, the cores which are necessary for the injection molding process which eventually produce the inside of the fiber feeding channel can be pulled out again from the form or from the completed rotor lid after the production of said rotor lid is completed. The molding method, in particular the injection molding method, makes it possible to produce the rotor lid in greater numbers, it being possible to produce the lid at the same time with lower tolerances and nevertheless economically. Such a channel has nevertheless the disadvantage that the design of its inner contour is very much restricted. In addition, the surface quality of the inside contour of the channel is not sufficiently high and must often be machined at high cost. A continuous transition between different cross-sections, e.g. also in the area of a diameter reduction of the channel or an enlargement of the diameter, is not possible or possible only with great difficulty.

OBJECTS AND SUMMARY OF THE INVENTION

It is therefore an object of the present invention to propose a channel with an inside contour that can be configured in various ways without any of the disadvantages of the state of the art, and in addition using the channel as a fiber feeding channel in an open-end rotor spinning, device as well as to propose a process for the manufacture of such a channel. Additional objects and advantages of the invention will be set forth in part in the following description, or may be obvious from the description, or may be learned through practice of the invention.

Thanks to the design of the channel according to the invention for the guiding or conveying of fibers, fiber slivers or yarns, the channel can be made with practically any desired inside contour. The quality of the surface inside the channel is very high, i.e. it has none of the otherwise normal disfigurements which are caused by the manufacturing process. Pores and slivers, such as with cast channels for example, cannot occur. An embodiment of the channel according to the invention can be produced at low cost and equal quality, even in large quantities. Furthermore a channel designed according to the invention can be used in areas where channels with diameters measuring a few millimeters are needed, e.g. with twisting pipes or spinning nozzles, as well as where channels of 30 mm and more are used, e.g. as sliver channels, e.g. on draw frames. The channel is especially advantageous if made of brass, since brass maintains especially good surface quality even when extensive deformation takes place. In order to give it especially good resistance to wear, the channel can be made of steel according to another advantageous embodiment of the invention. If special steel is used, it is furthermore advantageously not oxidized. It is especially advantageous to use the channel as a conveying channel for fibers in an open-end friction spinning machine or rotor spinning machine. In another advantageous embodiment, the channel is a sliver channel on a draw frame.

By making the open-end rotor spinning device according to the invention, the lid as such, i.e. without the channel, as well as the channel can be produced in an optimized manner. The two can be made of different materials and be produced by different manufacturing methods, whichever is the most advantageous in either case. Thereby an optimum can be attained for each separate part. Thus the lid can be made of a low-cost material and the conveying channel of an especially resistant, wear-resistant material.

In designing the open-end rotor spinning device according to the present invention, the open-end spinning device can be made at especially low cost whereby at the same time diverse forms of the conveying channel are possible. It is in any case possible to make the inside of the conveying channel of an especially high quality. It is possible to produce nearly any inside contour of the conveying channel, whereby at the same time great surface quality is attained in the interior of the conveying channel and economic production is made possible. Designing the open-end rotor spinning device according to the invention, whereby the conveying channel is a tubular component which has been deformed by subjecting its interior to a medium under very high pressure (hydrostatic stretch deformation), the conveying channel of the open-end rotor spinning device is given favorable spinning characteristics thanks to the advantageous design of its inner contour and the evolution of its cross-sections. The surface on the inside of the conveying channel which comes into contact with the fibers is advantageously smooth, so that undisturbed conveying of the fibers takes place. The form of the inside contour of the conveying channel can be selected with practically no limitation, only in accordance with the technological requirements, and does not depend on manufacturing limitations. In the same manner, the material of the conveying channel can be selected free of any limitations existing for the production of the lid.

It is especially advantageous if the lid is produced by molding, e.g. injection molding, since by molding or injection-molding the lid can be made and the conveying channel can be inserted into the lid in one operational step. It is especially advantageous to make the lid of a metal material, since such material has proven itself especially in the manufacture of lids for open-end rotor spinning devices.

Aluminum or zinc alloys are especially advantageous for this. In another advantageous embodiment of the cover, the latter is made of a synthetic material, e.g. synthetic resin, a thermoplastic or of duroplast, since this material is especially economical and makes it possible to easily form the conveying channel. It is an especially advantageous embodiment for the insertion of the conveying channel if it or the conveying channel are provided with snap connections so that the two parts can be joined together easily. It is advantageous to design the connection in this case in such a manner that it can be detached again, so that either the conveying channel or the cover can be replaced. In another advantageous embodiment, the snap connection cannot be opened, so that a permanent connection exists between the conveying channel and the cover. It is especially advantageous and safe for the operation if this connection is positive and interlocking. In another advantageous embodiment of the open-end rotor spinning machine, its conveying channel is designed so that it has an essentially rectangular cross-section. In another advantageous embodiment, the conveying channel is provided with a receiving element which receives the fibers leaving the vicinity of the take-up rollers directly from the opener roller housing. For this, the receiving part is made in one piece with the conveying channel in an especially advantageous case. The opening of the opener roller housing need then not be made in the form of a channel, since the conveying channel takes over the fibers directly at the opener roller. In another advantageous embodiment of the open-end rotor spinning device, the cross-sectional configuration of the conveying channel is made so that it goes without transition from a substantially rectangular cross-section to an elliptical cross-section. If the configuration of the conveying channel is essentially rectangular, it should advantageously be designed so that the ratio of length to width at a distance of up to 40 millimeters from the opener rollers may have a value of more than 4:1. As a result the fibers detaching themselves from the opener roller are especially certain to be detached over the entire width of the opener roller. In another advantageous embodiment of the invention, the conveying channel being essentially rectangular. The length to width ratio at a distance of up to 20 millimeters from the outlet of the conveying channel is given a value of at least 2:1. This makes it possible to achieve undisturbed and advantageous feeding of the fibers into the open-end spinning rotor. Thanks to the advantageous design of the invention, whereby the conveying channel has an essentially rectangular cross-section, and the ratio of length to width at a distance of over 20 mm from the outlet of the conveying channel has a lower value than within the range between 0 and 20 millimeters, the result is that the outlet opening of the conveyor channel in the vicinity of the spinning rotor is given an especially advantageous form and that the remaining area of the conveying channel requires less space in the lid. Thanks to the advantageous embodiment of the invention, in which the conveying channel is provided with a sudden widening of its cross-section between outlet and intake portion, the reduction of speed of the conveying which takes place at this point results in a new orientation of the fibers. In another advantageous embodiment of the invention, the conveying channel has a cross-section in an area between 50 millimeter before its outlet and the outlet which is smaller than the cross-section at the outlet, so that as a result a strong acceleration of the conveying air in the conveying channel advantageously takes place, making it possible to achieve stretching of the fibers. Thanks to the embodiment of the invention in which the cross-section of the conveying channel becomes continuously wider towards the outlet of the fiber feeding channel, it is possible, e.g. in the vicinity of the outlet, to reduce the air speed to such an extent that the air is more easily separated from the fibers. Of special advantage is the embodiment in which the cross-sectional changes take place continuously, whereby especially favorable flow conditions can be ensured.

It is especially advantageous if the conveying channel is made of a brass alloy, as the latter has a good quality surface. In another advantageous embodiment, the conveying channel is made of a steel material since this is especially resistant and at the same time ensures good surface quality during manufacture. By using special steel according to the invention for the manufacture of the conveying channel, the wear of the latter is especially low. In an especially advantageous embodiment of the invention, a connection piece is formed on it. The connection piece is here made at the same time as the forming of the inside contour of the conveying channel, so that the transitions from conveyor channel to connection piece as well as to its inner surface are advantageously smooth and flowing. Thanks to the connection piece air and/or fibers can be taken from or fed to the conveying channel advantageously.

By manufacturing a conveying channel according to the process of the present invention, the result is that its surface inside the channel can be produced before changing the form with a high surface quality without damage to same when the conveying channel is given its final form. Furthermore, a conveying channel can be produced which may have nearly any desired inside contours. In addition, the process is suitable for the manufacture of large quantities of low-cost conveying channels with constant high quality. In an especially advantageous further development of the process, the outside contour is determined by a tool, so that forming to precise measurements and with repeatability of the conveying channel is possible.

In an especially advantageous embodiment of the process, a blank which has already been produced by forming is annealed several times if necessary so that its capacity of being formed is again increased, so that it can now be made in two or more steps. It is especially advantageous to use a brass alloy for the conveying channel, since it is especially easy to form while maintaining high surface quality. Steel is used to advantage as a material for the conveying channel as it is especially resistant to wear.

DETAILED DESCRIPTION OF THE PREFERRED EMBODIMENTS

Figure 1:
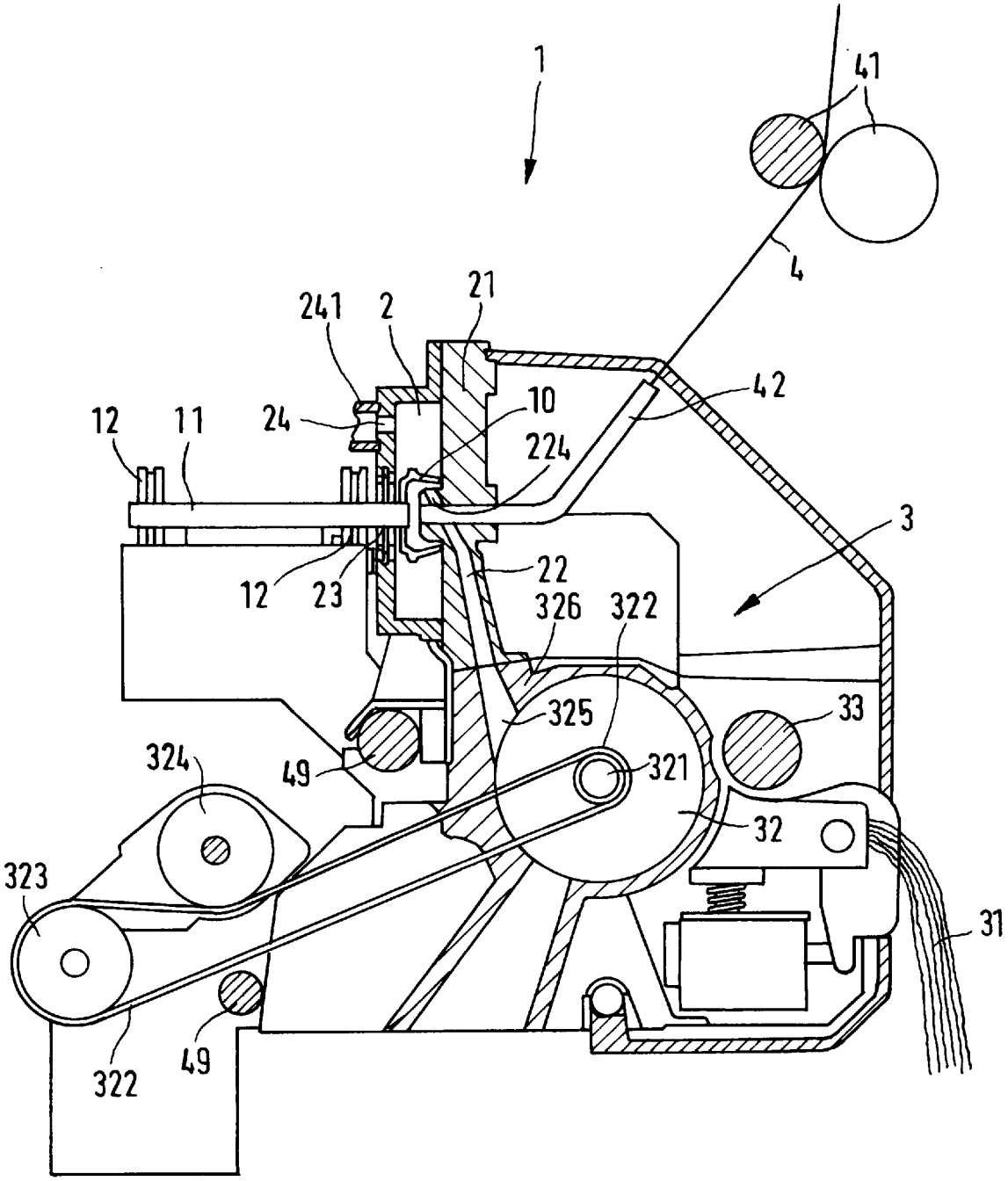
FIG. 1 shows a lateral view of an open-end rotor spinning device, in a section.

Reference will now be made in detail to the presently preferred embodiments of the invention, one or more examples of which are shown in the drawings. Each example is provided by way of explanation of the invention, and not as a limitation of the invention. For example, features illustrated or described as part of one embodiment can be used on another embodiment to yield still a further embodiment.

An open-end rotor spinning device 1 as shown in FIG. 1 consists essentially of a spinning rotor 10, which is rotating in a rotor hosing 2, and of an opener unit 3 which opens a fiber sliver 31 delivered to it into individual fibers, so that these can be fed to the spinning rotor 10. The opener unit 3 is equipped with an opener roller 32 to open the fiber sliver 31 into individual fibers. The fiber sliver 31 is fed via the feed shaft 33. Opener roller 32 is driven via its pulley 321, around which a drive belt 322 is looped. The drive belt 322 is driven by a driven drive shaft 323, whereby it is held under tension by a tension roller 324. The fibers separated by the opener roller 32 leave the area of the opener roller through and opening 325 of the opener roller housing 326. This is caused by a negative pressure in the rotor housing 2 which continues via the conveying channel in the lid 21 of the rotor housing 2 until proximity of the opener roller. At variance with that which is shown in FIG. 1, the conveying channel 22 of the lid 21 can also extend to the opener roller 32, so that the conveying channel 22 is provided with a receiving element (222, FIG. 2) which then constitutes the opening 325 of the opener roller housing 326, as an alternative to FIG. 1. The conveying channel 22 extends with its outlet into the spinning rotor 10 which extends into the rotor housing 2. The spinning rotor 10 is mounted on its shaft 11 in a known manner by means of supporting disks 12 and is driven by tangential belts which are not shown. The shaft 11 extends through a seal 23 into the rotor housing 2. The rotor housing 2 has a suction opening 24 which is connected to a suction channel 241. The yarn 4 formed in the spinning rotor 10 is removed from the spinning rotor 10 by means of a pair of driven draw-off rollers 41 through a draw-off pipe 41 and is then wound up into a cross-wound bobbin. The open-end rotor spinning device 1 is supported on rods 49 which are part of the frame of the appertaining rotor spinning machine.

Figure 2:
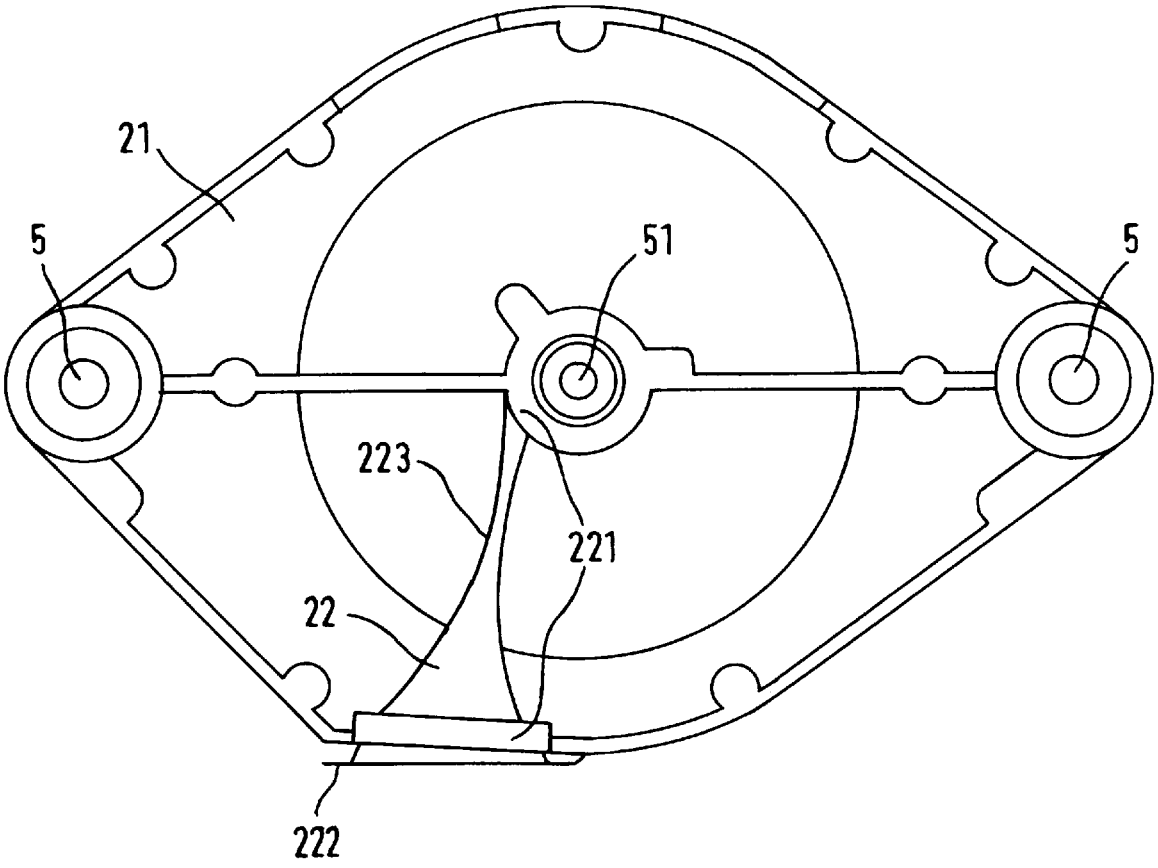
FIG. 2 shows the lid of a rotor housing with a conveying channel molded into it.

FIG. 2 shows a lid 21 of an open-end rotor spinning device designed according to the invention. The lid of FIG. 2 is shown in a top view of the side away from the spinning rotor. The lid 21 has a conveying channel 22 which is held by fastening ridges 221. The fastening ridges 221 are made of an aluminum alloy, as the rest of the lid 21, and are made by injection molding. The fastening ridges 221 are formed so that they surround the conveying channel 22 and thus connect it permanently to the lid 21. The conveying channel 22 itself is made of a brass alloy and was inserted into the mold when the cover 21 was formed, so that the conveying channel 22 has been connected to the lid 21 via the suitably formed fastening ridges. Due to the design of the lid according to the invention the latter, at variance with FIG. 1, can itself be very thin, since the conveying channel is an autonomous component and the lid only serves to cover the rotor housing and to support the conveying channel 22. The lid 21, since it is made to be replaceable, is provided with two bores 5 by means of which, and together with screws, it can be attached to a bearing plate (not shown) for example on the open-end rotor spinning device. In the center of the lid a hole 51 is provided for the passage of a draw-off pipe 42 (FIG. 1) to draw off the yarn from the rotor. The conveying channel is made in one piece with a receiving element 222 with which the conveying channel 22 presses in a sealing manner against the opener roller housing to receive fibers from same and to convey them to the spinning rotor. The conveying channel 22 has a cross-sectional diminution 223 between the receiving element 22 and its outlet which is away from the receiving element 222. In this area, the speed of flow of the mixture of fibers and air conveyed through the conveying channel increases so that a new orientation of the fibers in the flowing air is achieved. The conveying channel 22 is a part which is made separately from the lid 21 and has been made of a blank which is pipe-shaped according to the invention. For this, the blank was introduced into a divided form by which it was enclosed essentially completely. Between the blank and the inside contour of the form was, at first, an interval in many areas. On at least one of its ends, the blank was connected to a pressure source and was closed on its other side. By injecting a medium under high pressure (approx. 2,000 bar to 2,500 bar) the blank was formed through widening in such manner that its outer contour was pressed against the inside contour of the forming tool. This makes it possible to give the conveying channel through its outer contour nearly any desired inside contour. The inside contour practically matches the outside contour of the conveying channel, taking into consideration its wall thickness which was changed by forming. The conveying channel not only is provided with an inside contour which is independent of the constrictions of the molding process, but also an inside surface of very high quality. This means that the inside contour meets all requirements as to roughness and smoothness of the surface as required for the conveying of fibers. Machining is practically not required. The different dimensions of the conveying channel shown in FIG. 2 are represented in an exaggerated manner for the sake of clarity.

Figure 3:
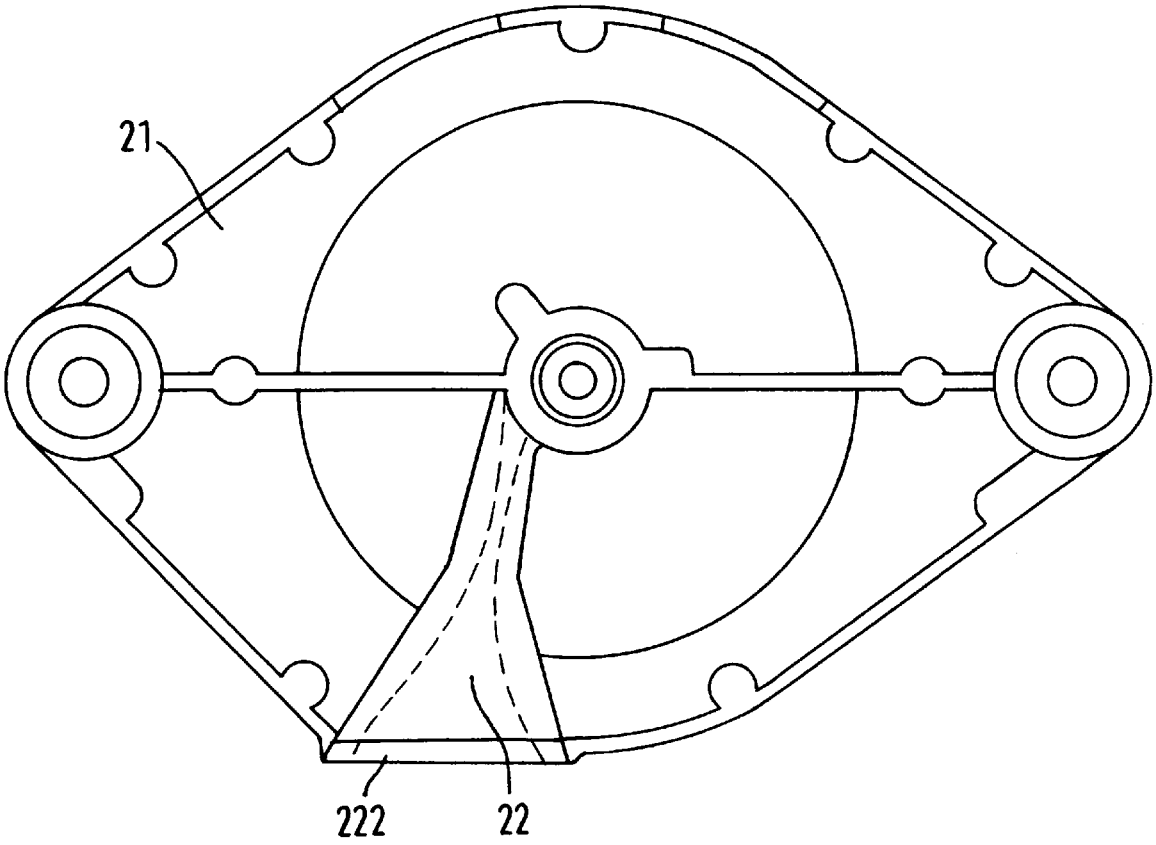
FIG. 3 shows the lid of a rotor housing with a conveying channel molded into it.

FIG. 3 shows a lid 21 of an open-end rotor spinning device made according to the invention in which the conveying channel 22 is also a component made separately from the remaining portion of the lid 21 and which was then molded into the lid during the molding of the lid 21, e.g. by injection molding. The conveying channel 22 is therefore shown by a broken line. The receiving part 222 to attach the conveying channel 22 to the opener roller is formed for the lid of FIG. 3 on the actual base part of the cover and not on the conveying channel 22. The evolution of the cross-section of the conveying channel 22 is similar to that of FIG. 2.

Figure 4:
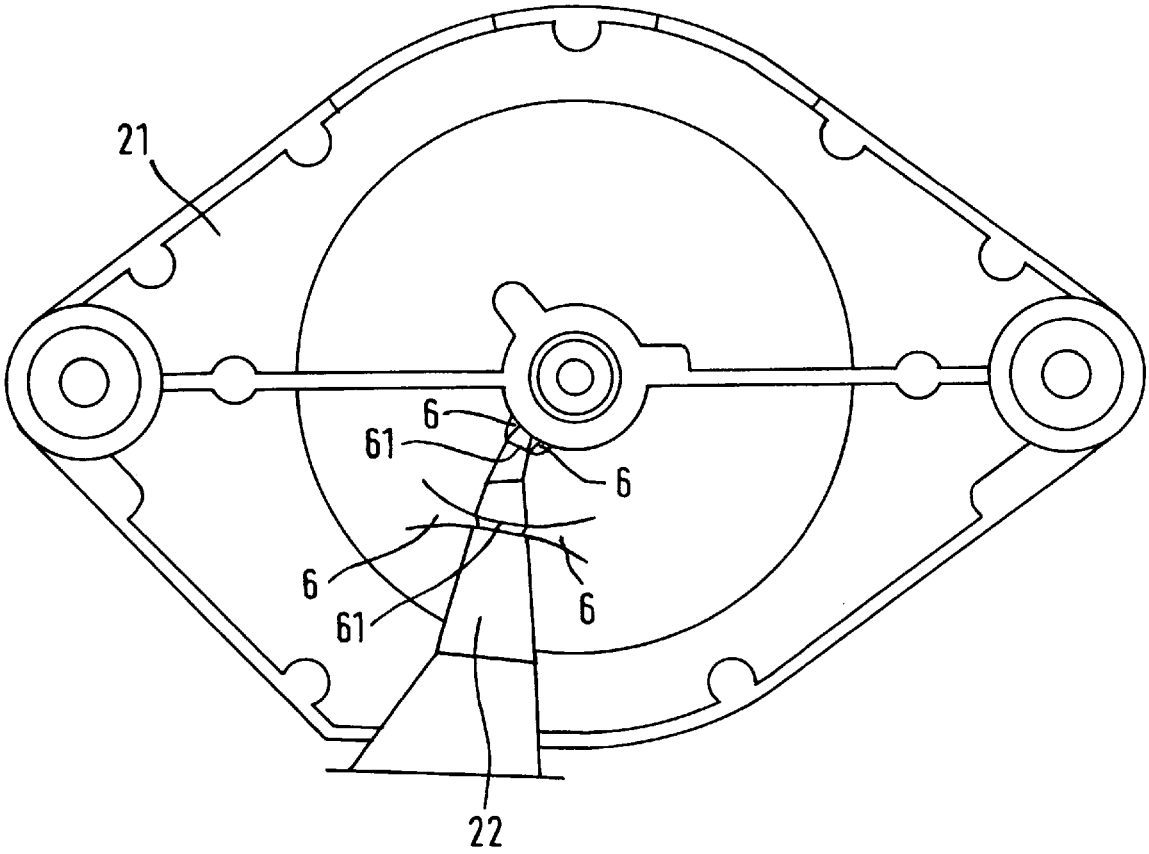
FIG. 4 shows the lid of a rotor housing with snapped-in conveying channel.

FIG. 4 shows a cover 21 for an open-end rotor spinning device in which the base body of the lid 21 and the conveying channel are also separately produced components, and where the lid 21 and the conveying channel 22 are connected to each other via snap-on connections 6. The snap-on connections surround the conveying channel 22 in part in the area of a groove 61, so that shifting of the conveying channel 22 within the snap-on connection is not possible. The result of this is a rigid connection between the conveying channel 22 and the lid 21 which does not become detached during the operation of the open-end rotor spinning device. To replace the lid or the conveying channel, the snap-on connection can be opened and the lid or conveying channel can be replaced.

Figure 5:
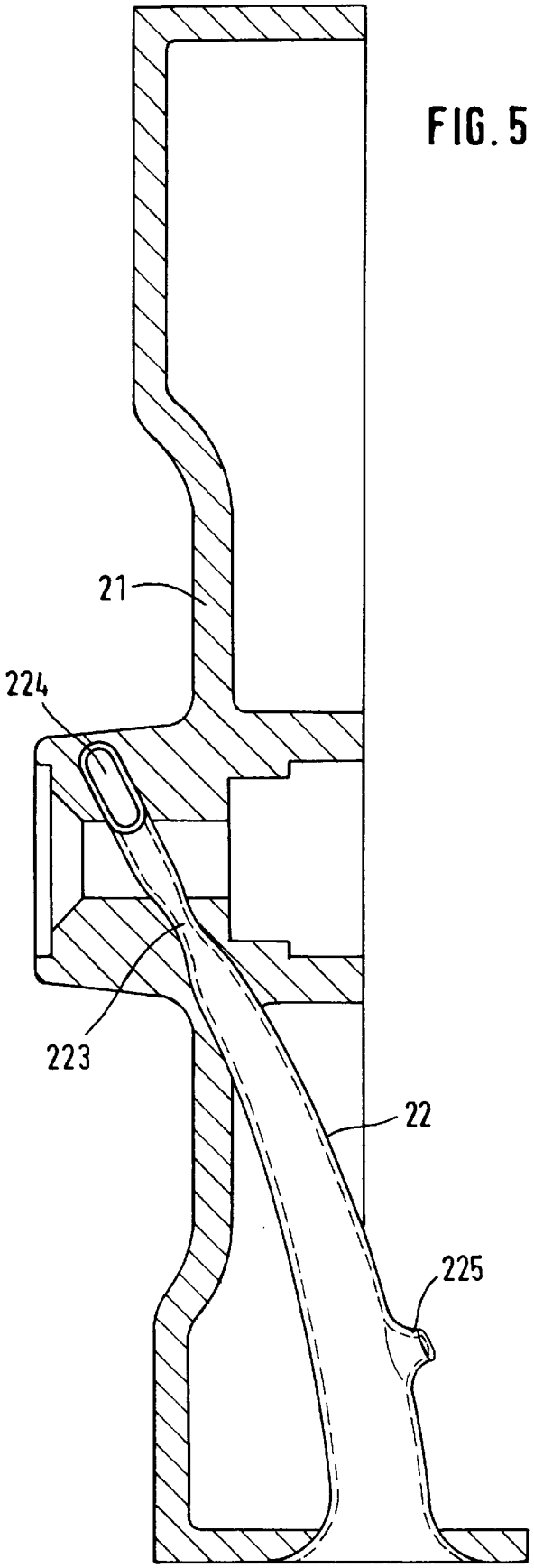
FIG. 5 shows a lid with a conveying channel molded into it, in a section.

FIG. 5 shows a lid 21 with a conveying channel 22 integrated into the mold. The cut-away drawing of the lid shows the conveying channel 22 laid open. Only the area of fiber entry into the conveying channel is in part surrounded by the lid. The conveying channel is made according to the invention; it is designed with a reduced cross-section in an area of 50 mm before its outlet 224. This reduced outlet has on the one hand a positive effect on the orientation of the fibers in the conveying channel and thereby also in the rotor and yarn, and on the other hand offers the advantage that the cross-sectional reduction 223 results in an interlocking connection between lid and conveying channel as the conveying channel 22 is formed into the lid 21. The conveying channel is furthermore equipped with a connection piece 225. Through the latter, air and/or fibers can be fed to the conveying channel or can be removed from same in a known manner when needed. In addition it is connected to a connection channel which is not shown, and which could be connected to the opener unit 3 or to the rotor housing, for example.

Figure 6:
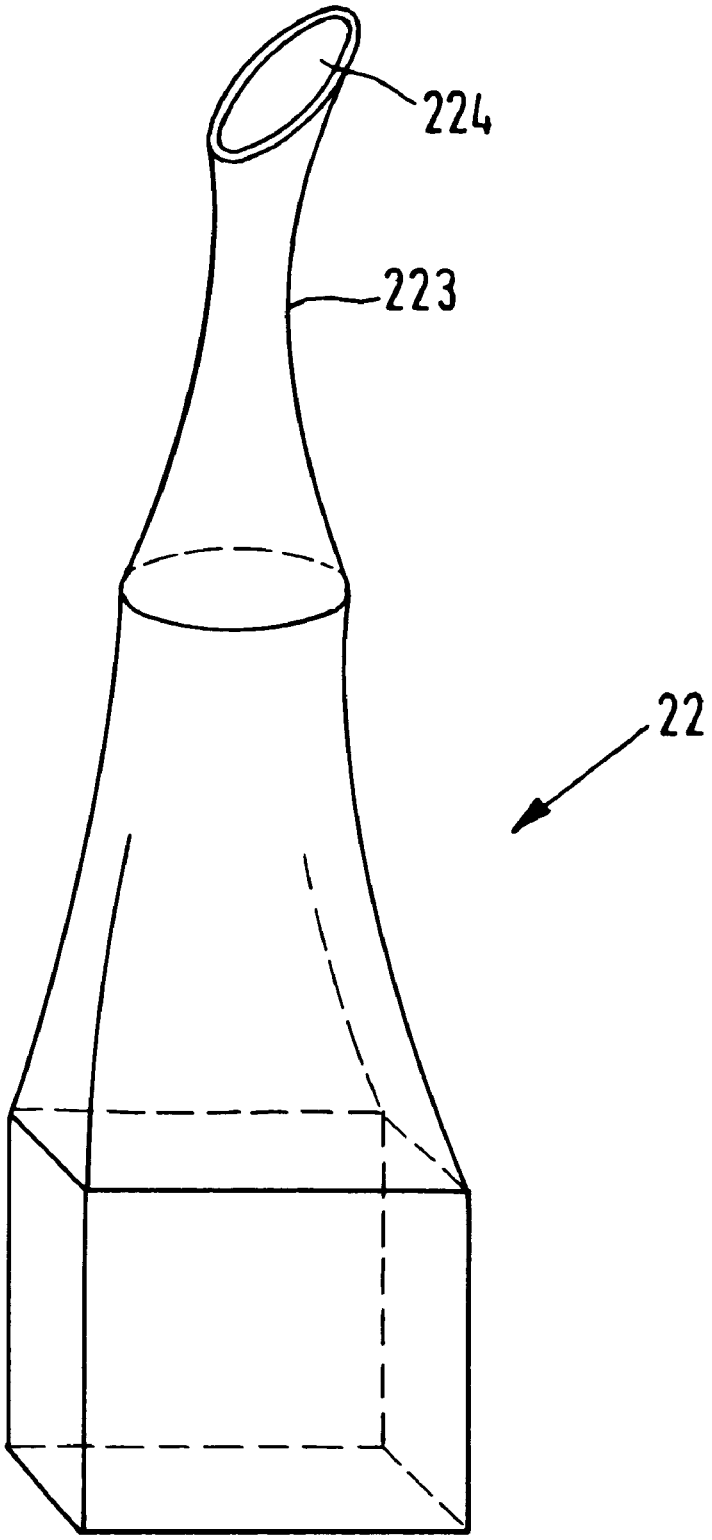
FIG. 6 shows a conveying channel made according to the invention which has several different cross-sectional configurations over its length.

FIG. 6 shows a conveying channel produced in accordance with the process of the invention. The starting material for the blank is a hollow body, e.g. a pipe with a wall that is thicker than that of the completed, formed conveying channel. When already considerable forming is necessary to produce the blank, the blank is annealed to reduce tensions. For the conveying channel, metal materials, in particular steel, special steel, copper, brass and nickel, and to a limited extent also aluminum are used. A sufficient expandability of the material is important. Brass, steel, in particular special steel are especially advantageous in producing a conveying channel. In order to form the blank it is placed into a divided forming tool 7, see FIG. 7. The forming tool 7 is equipped with a recess, the pattern 73 in the mold joint 72 which matches the outer contour of the completed conveying channel. After closing the forming tool, the blank is filled from the inside with a medium under very high pressure, preferably water, so that the blank 71 widens and presses against the contour of the pattern 73 of the forming tool 71. Taking into account the wall thickness, the outer contour of the formed blank corresponds to the inside contour of the completed conveying channel. The two ends of the conveying channel may still have to be machined, e.g. by shortening them. By using the manufacturing method for a conveying channel according to the invention, inside contours can be produced which are not possible with the known processes, or are only possible at great cost. The surface quality attainable through the invention is especially advantageous. The different cross-sections of the conveying channel and their transitions as well as cross-sectional reductions 223 in segments, as shown in FIG. 6, for example, can easily be realized.

Figure 7:
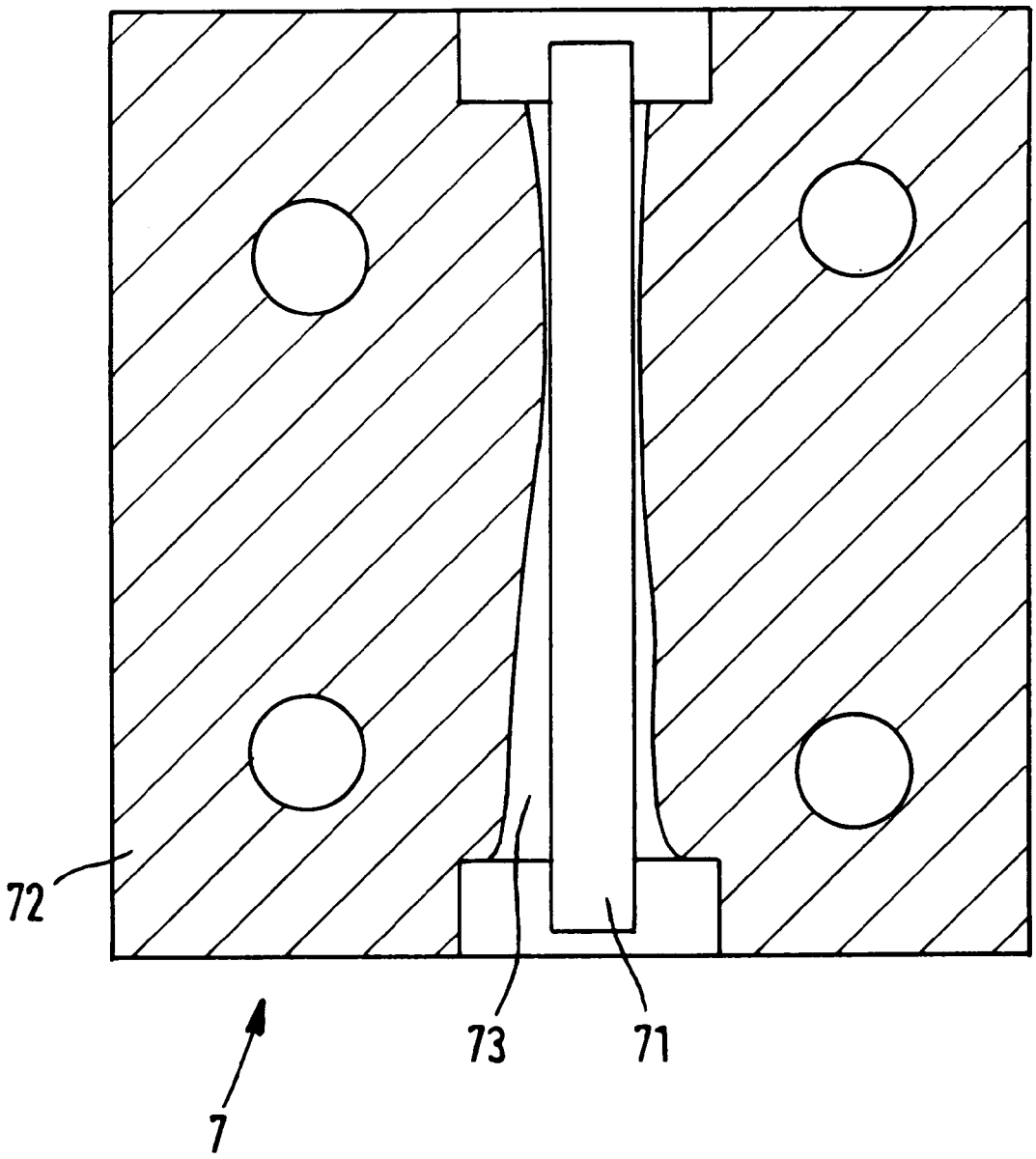
FIG. 7 shows a diagram of an open forming tool.

FIG. 7 shows a diagram of an open forming tool 7 with a blank 71. The mold joint 72 of the forming tool 7 is shown by hatch marks. The pattern 73 which is not hatch-marked, constitutes the outside contour of the complete conveying channel. Upon closing the forming tool 7, the open ends of the blank 71 are sealed off by connection pieces which are not shown, and the blank is filled from inside with water, the water is put under pressure and the blank is brought to press against the contour of pattern 73 of the forming tool. After removal, the ends of the formed blank are machined and the conveying channel has received its final form. It is easily possible to coat the conveying channel, e.g. in order to improve its resistance to wear or to improve its surface quality. A conveying channel made according to the present invention can be used advantageously also for fiber conveying on draw frames.

The present invention can be used not only as shown in detail with open-end rotor spinning machines but also with other open-end spinning machines, e.g. with friction spinning machines where the separated fibers are also conveyed through a fiber feeding channel of the spinning device. Furthermore it is advantageously possible to use a channel according to the invention in spinning machines where the yarn is treated or formed through a tubular false-twisting element, such as is indicated for example in DE 31 35 337 A1. Using a channel according to the invention as a sliver channel to convey fiber slivers on a draw frame is also very advantageously possible. Thus, for example, a sliver channel as shown in DE 41 39 910 A1, can be produced with finishing accuracy and at low cost according to the process of the invention. Especially a draw frame for doubling and drafting fiber slivers can be equipped to great advantage with a conveying channel according to the invention, so that the stretched fiber sliver can be deposited by the latter safely and delicately in a container, e.g. a can.

Figure 8:
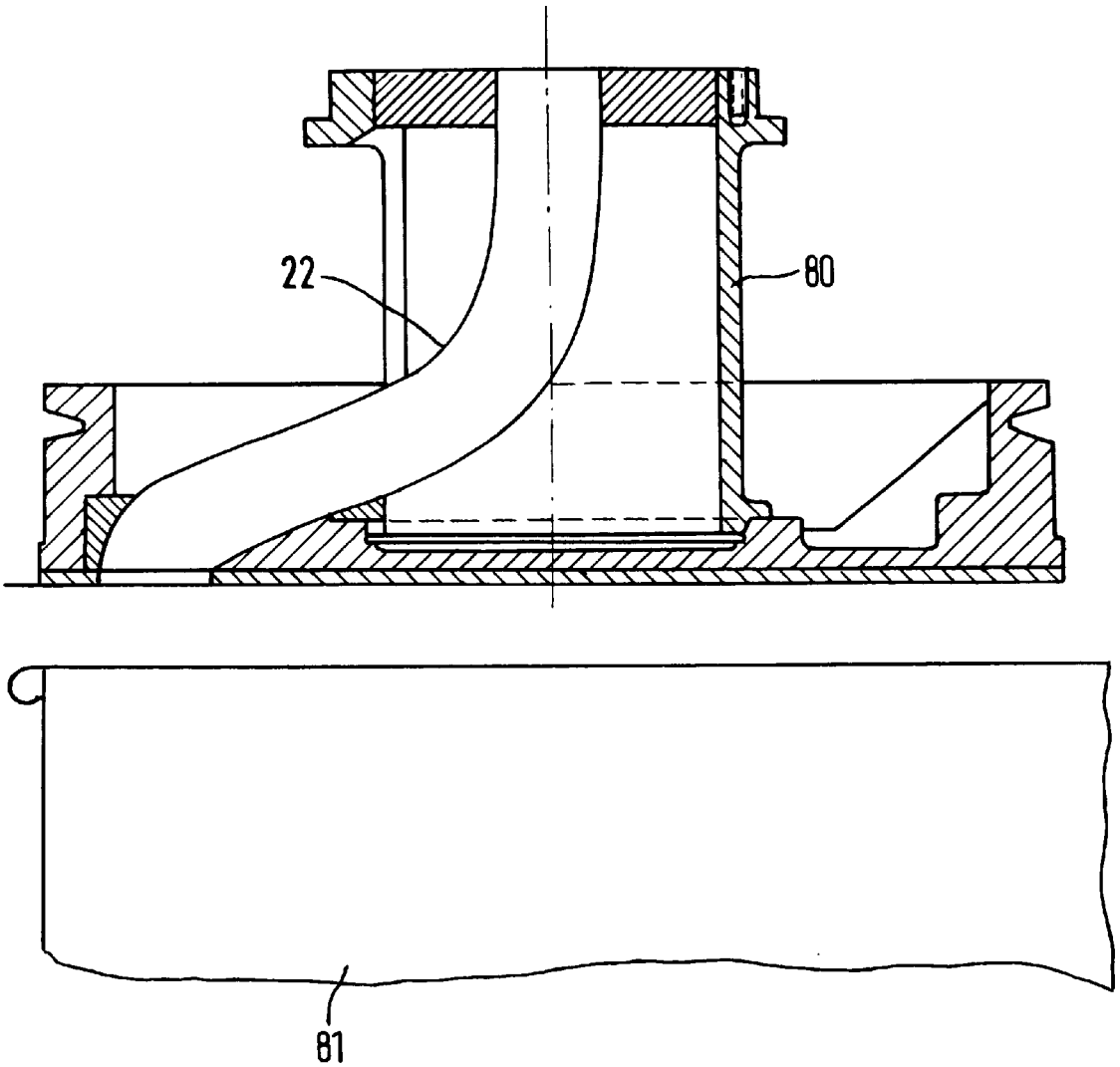
FIG. 8 shows a rotary plate of a draw frame with a sliver channel according to the invention.

FIG. 8 shows part of a spinning machine, a draw frame, with a channel 22 which is integrated into the rotary plate 80 of the draw frame. Due to the fact that the rotary plate 80 rotates around its vertical axis, the fiber sliver is deposited via channel 88 in a known manner into the can 81 placed below the rotary plate 80. To ensure delicate deposit of the fiber sliver, it is necessary that the channel 22, here called the sliver channel, has a smooth, undisturbed surface on the inside. Channel 22 for a draw frame has an inside diameter of approx. 30 mm. By using the invention, the sliver channel can be produced more easily and at lower cost, whereby the sliver channel is given at the same time a surface and a form of high quality.

It should be apparent to those skilled in the art that various modifications and variations can be made in the present invention without departing from the scope and spirit of the invention. It is intended that the present application cover such modifications and variations as come within the scope of the appended claims and their equivalents.

We claim:

1. An open-end spinning device, comprising a spinning rotor disposed in a rotor housing and a lid covering said housing, said lid comprising a base body formed from a first molded material with a conveying channel non-removably disposed therein in a form for conveying fibers from an opener roller outlet to said spinning rotor, said channel comprising a metallic tubular component of a second material different from said first molded material formed separate from said lid and molded directly into said lid during molding of said lid, said tubular component having a configuration formed by injecting a pressurized medium into said tubular component.

2. The spinning device as in claim 1, wherein said lid is formed from a synthetic material.

3. The spinning device as in claim 1, wherein said channel comprises a substantially rectangular cross-section along a substantial portion of its length.

4. The spinning device as in claim 1, wherein said channel further comprises a receiving element disposed for receiving fibers from an opener roller.

5. The spinning device as in claim 4, wherein said receiving element is formed integral with said channel as a single component.

6. The spinning device as in claim 1, wherein said channel comprises a rectangular cross section that smoothly merges into an essentially elliptical cross section without defined transition lines.

7. The spinning device as in claim 1, wherein said channel comprises a substantially rectangular cross-section over at least a portion of the length thereof, said rectangular cross section having a ratio of length to width of at least 4:1 at a distance of up to about 40 mm from said opener roller.

8. The spinning device as in claim 1, wherein said channel comprises a substantially rectangular cross section over at least a portion of the length thereof, said rectangular cross section having a ratio of length to width that is greater at a distance of more than about 20 mm from said outlet than in an area of from about 0 to 0 mm from said outlet.

9. The spinning device as in claim 1, wherein said channel has a widening of its cross section in an area from about 50 mm to said outlet.

10. The spinning device as in claim 1, wherein said channel has a cross section in an area from about 50 mm to said outlet that is smaller than the cross section at said outlet.

11. The spinning device as in claim 10, wherein said cross section continuously widens from about 50 mm to said outlet.

12. A process for making a textile machine rotor lid with conveying channel for conveying fibers, fiber sliver, or yarns, said process comprising inserting a deformable tubular blank into a tool which encloses the blank, the tool having a desired pattern defined therein, and introducing a pressurized medium into said tubular blank at a pressure sufficient to cause the blank to widen and deform into the desired pattern defined in the tool to form the conveying channel; and setting the conveying channel in a mold for a rotor lid and molding the rotor lid with the conveying channel integrally and non-removably set therein.

* * * * *